US010267248B2

(12) United States Patent
Kimoto et al.

(10) Patent No.: US 10,267,248 B2
(45) Date of Patent: Apr. 23, 2019

(54) EVAPORATED FUEL PROCESSING DEVICE

(71) Applicant: AISAN KOGYO KABUSHIKI KAISHA, Obu-shi, Aichi-ken (JP)

(72) Inventors: Junya Kimoto, Obu (JP); Yoshikazu Miyabe, Obu (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 64 days.

(21) Appl. No.: 15/507,323

(22) PCT Filed: Aug. 27, 2015

(86) PCT No.: PCT/JP2015/074144

§ 371 (c)(1),
(2) Date: Feb. 28, 2017

(87) PCT Pub. No.: WO2016/035654

PCT Pub. Date: Mar. 10, 2016

(65) Prior Publication Data

US 2017/0284317 A1 Oct. 5, 2017

(30) Foreign Application Priority Data

Sep. 1, 2014 (JP) ..... 2014-176951

(51) Int. Cl.
*F02D 41/00* (2006.01)
*F02M 25/08* (2006.01)

(52) U.S. Cl.
CPC ..... *F02D 41/004* (2013.01); *F02M 25/089* (2013.01); *F02M 25/0836* (2013.01); *F02D 2200/06* (2013.01)

(58) Field of Classification Search
CPC ..... F02D 41/004; F02M 25/0836
See application file for complete search history.

(56) References Cited

U.S. PATENT DOCUMENTS 6,338,336 B1 * 1/2002 Iida ..... F02D 41/0042 123/520
6,698,280 B1 * 3/2004 Iden ..... F02M 25/0818 73/114.38

(Continued)

FOREIGN PATENT DOCUMENTS

CN 102162412 A 8/2011
DE 102013016984 A1 4/2014

(Continued)

OTHER PUBLICATIONS

International Patent Application No. PCT/JP2015/074144 International Search Report dated Nov. 24, 2015 (6 pages).

(Continued)

*Primary Examiner* — Hung Q Nguyen
*Assistant Examiner* — Xiao En Mo
(74) *Attorney, Agent, or Firm* — Conley Rose, P.C.

(57) ABSTRACT

An evaporated fuel processing device configured to adsorb evaporated fuel in a fuel tank to a canister and to feed the adsorbed evaporated fuel to an engine. The device includes an inner pressure sensor configured to detect a pressure in an interior space of the fuel tank, a valve-opening start position determination means configured to change the stroke amount of a flow control valve from an initial condition and to determine a valve-opening start position of the flow control valve based on a requirement that a range of variation of the inner pressure is equal to or greater than a predetermined value, a learning means configured to store the valve-opening start position, and a prohibition means configured to prohibit the valve-opening start position determination means from determining the valve-opening start position when the inner pressure falls within a predetermined pressure range relative to the atmospheric pressure.

4 Claims, 6 Drawing Sheets

(56) References Cited

U.S. PATENT DOCUMENTS 8,104,453 B2 * 1/2012 Kobayashi ..... F02D 41/0032 123/519
8,627,802 B2 1/2014 Horiba et al.
9,284,923 B2 3/2016 Kimoto et al.
2004/0250805 A1 * 12/2004 Osanai ..... F02D 41/004 123/698
2006/0090553 A1 * 5/2006 Nagasaki ..... F02M 25/0818 73/114.43
2011/0220071 A1 * 9/2011 Horiba ..... F02M 25/0836 123/520
2014/0257672 A1 * 9/2014 Surnilla ..... F02M 25/089 701/103
2014/0318506 A1 * 10/2014 Yang ..... F02D 41/042 123/519
2015/0059890 A1 * 3/2015 Iwaya ..... F02M 25/0809 137/557
2015/0090232 A1 * 4/2015 Peters ..... F02M 25/0854 123/520
2015/0122228 A1 * 5/2015 Bolger ..... F02M 25/0836 123/518
2015/0159566 A1 6/2015 Akita et al.
2015/0159567 A1 * 6/2015 Akita ..... F02D 41/003 137/624.27
2015/0322902 A1 * 11/2015 Akita ..... F02M 25/0809 123/519
2016/0356227 A1 * 12/2016 Akita ..... F02M 25/0836

FOREIGN PATENT DOCUMENTS

JP 2011-256778 A 12/2011
JP 2014-77422 A 5/2014
JP 2015-110914 A 6/2015

OTHER PUBLICATIONS

German Patent Application No. 11 2015 003 534.6, Office Action dated Mar. 20, 2017 (9 pages).
Chinese Office Action dated Jun. 27, 2018, for Chinese Application No. 201580045233.6 (5 p.).
English Translation of Chinese Office Action dated Jun. 27, 2018, for Chinese Application No. 201580045233.6 (5 p.).

* cited by examiner

EVAPORATED FUEL PROCESSING DEVICE

CROSS-REFERENCE TO RELATED APPLICATIONS

The present application is a National Phase entry of, and claims priority to, PCT Application No. PCT/JP2015/074144, filed Aug. 27, 2015, which claims priority to Japanese Patent Application No. 2014-176951, filed Sep. 1, 2014, both of which are incorporated herein by reference in their entireties.

STATEMENT REGARDING FEDERALLY SPONSORED RESEARCH OR DEVELOPMENT

Not applicable.

BACKGROUND

The present disclosure relates to an evaporated fuel processing device in which a flow control valve is used as a valve to be installed in a pathway connecting a fuel tank and a canister, and in which the flow control valve is held in a valve-closed condition when a stroke amount corresponding to an axial travel distance of a valve movable element to a valve seat is equal to or less than a predetermined amount from an initial condition, so as to be capable of holding the fuel tank in a hermetically closed condition.

An evaporated fuel processing device using a flow control valve described above as a valve to be installed in a pathway connecting a fuel tank and a canister is taught by Japanese Laid-Open Patent Publication No. 2011-256778. In the flow control valve, a valve movable element needs to be moved in a valve-opening direction by a predetermined amount before the flow control valve reaches a valve-opening start position at which a fuel tank and a canister are communicated with each other after the flow control valve initiates a valve-opening operation from an initial condition. Therefore, in order to quickly perform a valve-opening control of the flow control valve, the valve-opening start position is previously learned, so that the valve-opening control is generally started from the learned valve-opening start position. In order to perform such learning, the valve-opening start position has to be determined. A determination of the valve-opening start position is made by detecting a decrease in an inner pressure of the fuel tank.

BRIEF SUMMARY

However, when a differential pressure between the inner pressure of the fuel tank and the atmospheric pressure is small, even if the flow control valve reaches the valve-opening start position to communicate the fuel tank with the canister, the inner pressure of the fuel tank is nearly unchanged. Under the circumstance, when the valve-opening start position is determined based on the decrease in the inner pressure of the fuel tank, such a valve-opening start position may be incorrectly determined.

In view of such a problem, it is an object of the present disclosure to provide an evaporated fuel processing device in which a flow control valve described above is used as a valve to be attached to a pathway connecting a fuel tank and a canister, in which a valve-opening start position of the flow control valve at which a fuel tank and a canister are started to be communicated with each other is determined and learned after the flow control valve initiates a valve-opening operation, and in which the valve-opening start position is determined only under a circumstance that a differential pressure between an inner pressure of the fuel tank and the atmospheric pressure is sufficiently large, so that the valve-opening start position may be prevented from being incorrectly determined regardless of an environment of the fuel tank.

A first aspect in the present disclosure may provide an evaporated fuel processing device configured to adsorb evaporated fuel in a fuel tank to a canister and to feed the adsorbed evaporated fuel to an engine, in which a flow control valve is used as a valve to be installed in a pathway connecting a fuel tank and a canister, and in which the flow control valve is held in a valve-closed condition when a stroke amount corresponding to an axial travel distance of a valve movable element to a valve seat is equal to or less than a predetermined amount from an initial condition, so as to be capable of holding the fuel tank in a hermetically closed condition. The device may include an inner pressure sensor configured to detect a pressure in an interior space of the fuel tank as an inner pressure, a valve-opening start position determination means configured to change the stroke amount of the flow control valve from an initial condition in a valve-opening direction, and configured to determine a valve-opening start position of the flow control valve based on a requirement that a range of variation of the inner pressure detected by the inner pressure sensor is equal to or greater than a predetermined value, a learning means configured to store the valve-opening start position determined by the valve-opening start position determination means as a learned value that is used when a valve-opening control of the flow control valve is performed, and a prohibition means configured to prohibit the valve-opening start position determination means from determining the valve-opening start position when the inner pressure detected by the inner pressure sensor falls within a predetermined pressure range relative to the atmospheric pressure.

A second aspect in the present disclosure may provide an evaporated fuel processing device configured to adsorb evaporated fuel in a fuel tank to a canister and to feed the adsorbed evaporated fuel to an engine, in which a flow control valve is used as a valve to be installed in a pathway connecting a fuel tank and a canister, and in which the flow control valve is held in a valve-closed condition when a stroke amount corresponding to an axial travel distance of a valve movable element to a valve seat is equal to or less than a predetermined amount from an initial condition, so as to be capable of holding the fuel tank in a hermetically closed condition. The device may include an inner pressure sensor configured to detect a pressure in an interior space of the fuel tank as an inner pressure, a valve-opening start position determination means configured to change the stroke amount of the flow control valve from an initial condition in a valve-opening direction when the inner pressure is out of a predetermined pressure range relative to the atmospheric pressure, and configured to determine a valve-opening start position of the flow control valve based on a requirement that a range of variation of the inner pressure detected by the inner pressure sensor is equal to or greater than a predetermined value, and a learning means configured to store the valve-opening start position determined by the valve-opening start position determination means as a learned value that is used when a valve-opening control of the flow control valve is performed.

According to the first and second aspects, the valve-opening start position of the flow control valve may be determined only under the condition in which the inner pressure of the fuel tank is out of the predetermined pressure range relative to the atmospheric pressure. Thus, the valve-opening start position may be prevented from being incorrectly determined because the valve-opening start position cannot be determined under a condition that a differential pressure between the inner pressure of the fuel tank and the atmospheric pressure is small.

A third aspect in the present disclosure may correspond to the first aspect, wherein the inner pressure sensor is configured to detect a gage pressure with respect to the atmospheric pressure as a reference pressure, and wherein the prohibition means is configured to determine as to whether the inner pressure of the fuel tank falls within the predetermined pressure range relative to the atmospheric pressure or not based on only an output of the inner pressure sensor.

A fourth aspect in the present disclosure may correspond to the second aspect, wherein the inner pressure sensor is configured to detect a gage pressure with respect to the atmospheric pressure as a reference pressure, and wherein the valve-opening start position determination means is configured to determine as to whether the inner pressure of the fuel tank is out of the predetermined pressure range relative to the atmospheric pressure or not based on only an output of the inner pressure sensor.

According to the third and fourth aspects, a sensor configured to detect the gage pressure may be used as the inner pressure sensor. Therefore, in the prohibition means in the third aspect and the valve-opening start position determination means in the fourth aspect, it is possible to detect as to whether the inner pressure of the fuel tank falls within or is out of the predetermined pressure range relative to the atmospheric pressure by using only the output of the inner pressure sensor. As a result, there is no need to respectively provide a sensor to measure the inner pressure of the fuel tank and a sensor to measure atmospheric pressure. This may lead to a simplified structure.

DETAILED DESCRIPTION

Figure 1:
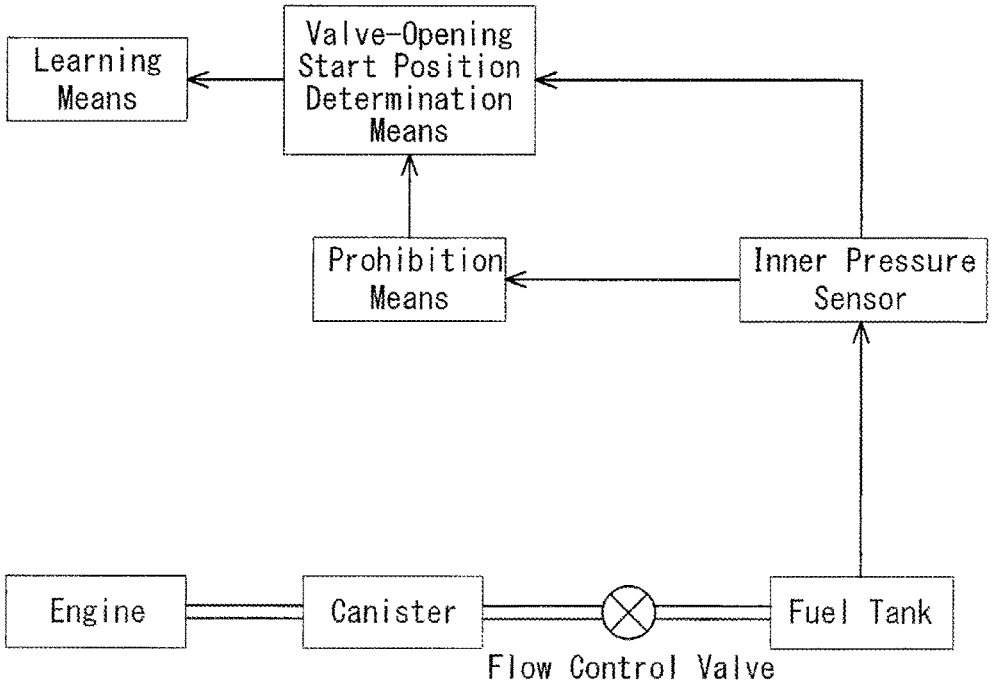
FIG. 1 is a conceptual diagram corresponding to a first aspect in the present disclosure.
Figure 2:
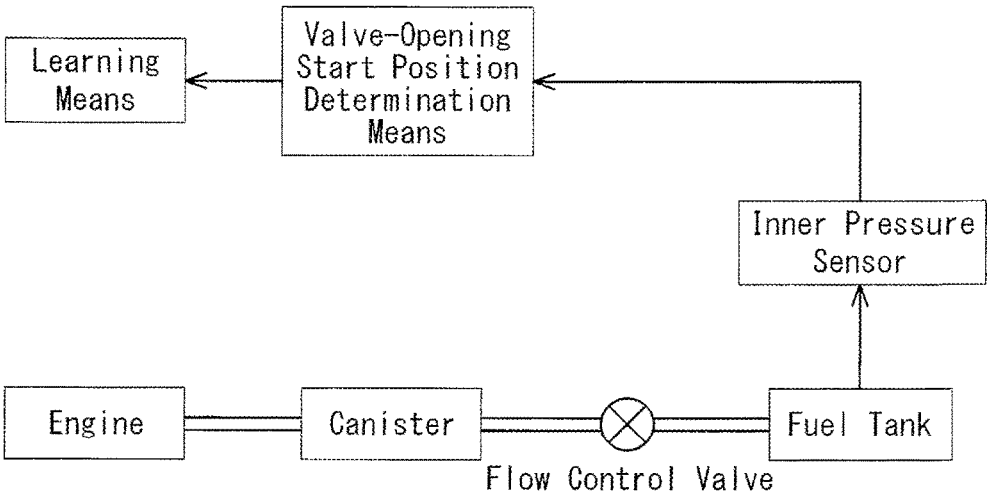
FIG. 2 is a conceptual diagram corresponding to a second aspect in the present disclosure.

FIGS. 1 and 2 are respectively conceptual diagrams corresponding to a first aspect and a second aspect of the present disclosure. Further, a description thereof may be omitted to avoid a repetition.

Figure 3:
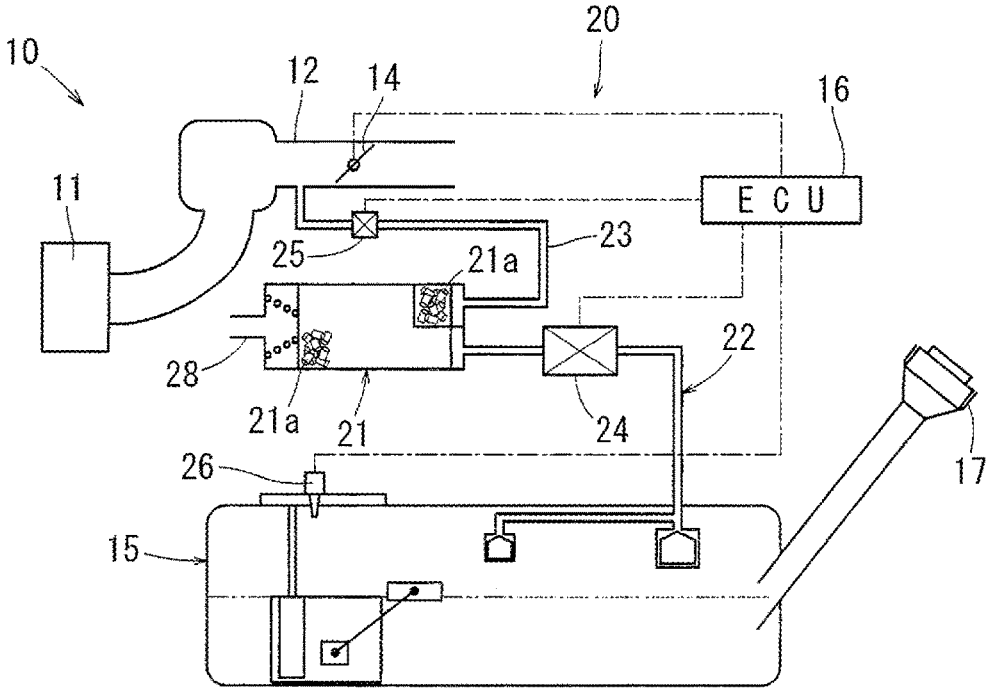
FIG. 3 is a structural diagram of a system according to a first embodiment of the present disclosure.

FIGS. 3 to 7 show a first embodiment of the present disclosure. As shown in FIG. 3, in the embodiment, an evaporated fuel processing device 20 is attached to an engine system 10 of a vehicle.

In FIG. 3, the engine system 10 is a known engine system in which an air-fuel mixture is fed into an engine body 11 via an intake passage 12. Air may be fed into the intake passage 12 via a throttle valve 14 while a flow rate thereof is controlled. Fuel may be fed into the intake passage 12 via a fuel injection valve (not shown) while a flow rate thereof is controlled. The throttle valve 14 and the fuel injection valve may respectively be connected to a control unit (ECU) 16. The throttle valve 14 may be configured to send signals representing opening degrees of the throttle valve 14 to the control circuit 16. The fuel injection valve may be configured such that a valve-opening time thereof can be controlled by the control unit 16. Further, the fuel may be fed into the fuel injection valve from a fuel tank 15.

The evaporated fuel processing device 20 may contain a canister 21 that functions to adsorb fuel vapor (which will be hereinafter referred to as "evaporated fuel") generated while filling or generated by fuel vaporization in the fuel tank 15 through a vapor conduit 22. Further, the evaporated fuel adsorbed on the canister 21 may be fed into the intake passage 12 positioned downstream of the throttle valve 14 via a purge conduit 23. A stepping motor driven closing valve (which corresponds to a flow control valve of the present disclosure and may be hereinafter simply referred to as a closing valve) 24 may be attached to the vapor conduit 22 so as to open and close the vapor conduit 22. Conversely, a purge valve 25 may be attached to the purge conduit 23 so as to open and close the purge conduit 23.

The closing valve 24 may be held in a valve-closed condition when a stroke amount corresponding to an axial travel distance of a valve movable element to a valve seat is equal to or less than a predetermined amount from an initial condition after a valve-opening operation of the closing valve 24 is initiated by a stepping motor, so as to be capable of holding the fuel tank 15 in a hermetically closed condition. Further, the stroke amount may be configured to be continuously varied. When the stroke amount is varied beyond the predetermined amount, the closing valve 24 may be changed to a valve-opened condition, so that the fuel tank 15 and the canister 21 may be communicated with each other. A position of the valve element at the time that the stroke amount exceeds the predetermined amount may correspond to a valve-opening start position in the present disclosure.

The canister 21 may be filled with activated carbon 21*a* as an adsorbent, so that the evaporated fuel introduced into the canister 21 through the vapor conduit 22 can be adsorbed by the activated carbon 21*a*. The adsorbed evaporated fuel can then be released into the purge conduit 23. The canister 21 may be communicated with an atmospheric conduit 28 open to the atmosphere. Therefore, when an intake negative pressure is applied to the canister 21 via the purge conduit 23, the atmospheric pressure can be fed to the canister 21 via the atmospheric conduit 28, so that the adsorbed evaporated fuel can be purged via the purge conduit 23. The atmospheric conduit 28 may be arranged such that air in the vicinity of a fuel filler opening 17 communicated with the fuel tank 15 can be aspirated.

Various specific signals necessary to control the valve-opening time of the fuel injection valve or other such factors may be sent to the control unit 16. In addition to the signals representing the opening degrees of the throttle valve 14 described above, detection signals of a pressure sensor (which corresponds to an inner pressure sensor of the present disclosure and will be hereinafter referred to as an inner pressure sensor) 26 for detecting inner pressures of the fuel tank 15 shown in FIG. 3 may be sent to the control unit 16. Further, the control unit 16 may be configured to control opening and closing operations of the closing valve 24 and the purge valve 25 shown in FIG. 3 as well as the valve-opening time of the injection valve described above. Further, the inner pressure sensor 26 may be a sensor configured to detect a gage pressure with respect to the atmospheric pressure.

Figure 4:
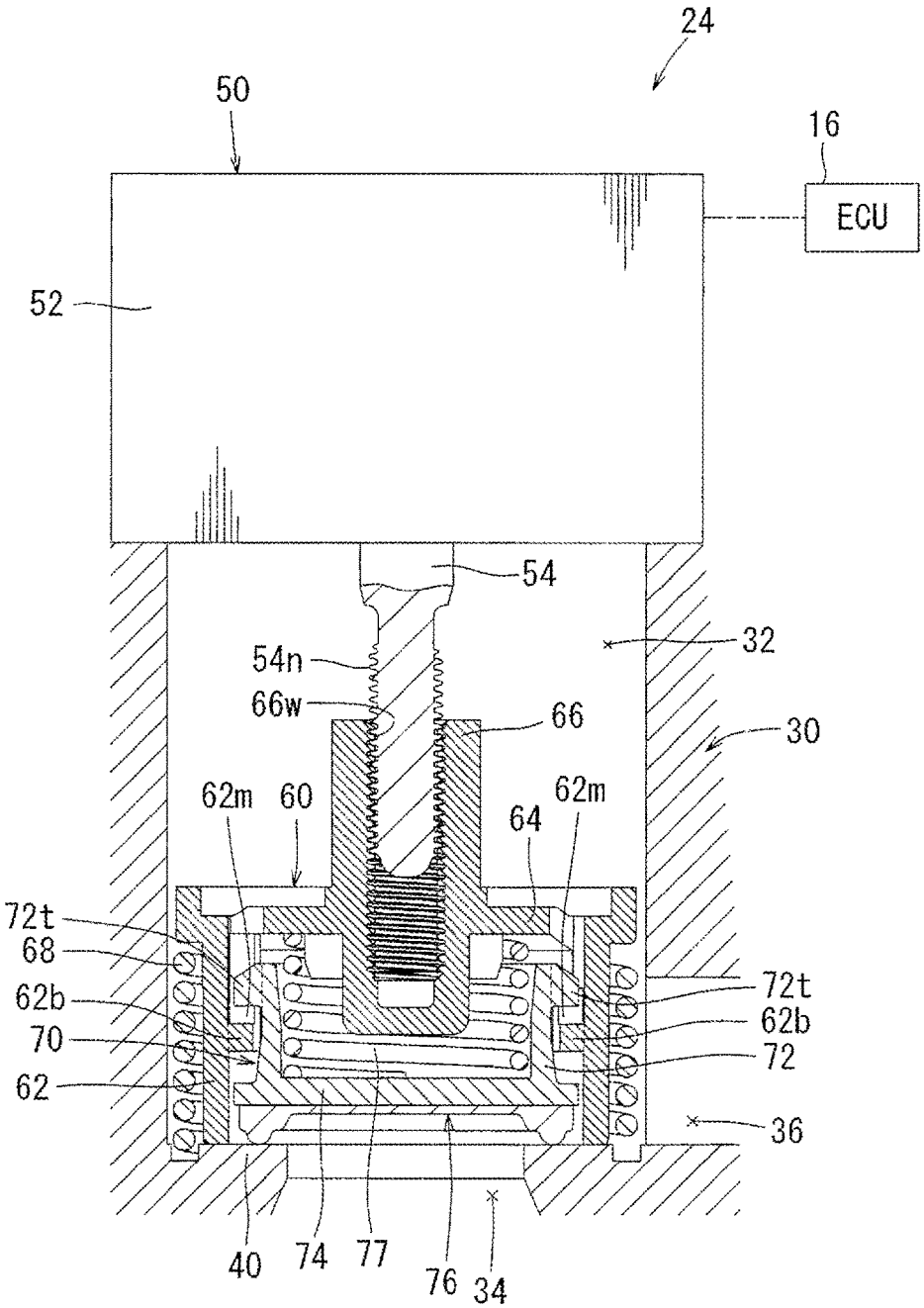
FIG. 4 is a vertical sectional view of a flow control valve used in the above-described embodiment, which view illustrates an initial condition.

FIG. 4 shows a structure of the closing valve 24. The closing valve 24 may include a substantially circular cylindrical valve guide 60 concentrically positioned in a circular cylindrical valve chest 32 of a valve casing 30 and a substantially circular cylindrical valve body 70 concentrically positioned in the valve guide 60. Conversely, the valve casing 30 may have an inflow passage 34 that is formed in a central portion of a lower end of the valve chest 32 and is communicated with the vapor conduit 22 communicated with the fuel tank 15. Further, the valve casing 30 may have an outflow passage 36 formed in a side wall of the valve chest 32 and communicated with the vapor conduit 22 communicated with the canister 21. Further, a motor body 52 of the stepping motor 50 is attached to an upper end of the valve casing 30 opposite to the lower end in which the inflow passage 34 is formed, so as to close an upper end of the valve chest 32.

The valve guide 60 and the valve body 70 may constitute the valve movable element of the present disclosure. Further, a circular valve seat 40 may be concentrically formed in an inner periphery of the lower end of the valve casing 30 in which the inflow passage 34 is formed. When the valve guide 60 and the valve body 70 contact the valve seat 40, the closing valve 24 may be placed in the valve-closed condition. To the contrary, when the valve guide 60 and the valve body 70 is spaced from the valve seat 40, the closing valve 24 may be placed in the valve-opened condition.

The valve guide 60 may be composed of a circular cylindrical wall portion 62 and an upper wall portion 64 closing an upper end opening of the cylindrical wall portion 62, so as to have a topped circular cylindrical shape. A cylindrical shaft portion 66 may be concentrically formed in a central portion of the upper wall portion 64. The cylindrical shaft portion 66 may have a female thread portion 66*w* formed in an inner circumferential surface thereof. The female thread portion 66*w* formed in the cylindrical shaft portion 66 of the valve guide 60 may be threadably connected to a male thread portion 54*n* formed in an outer circumferential surface of an output shaft 54 of the stepping motor 50. Further, the valve guide 60 may be axially (vertically) movably received in the valve casing 30 while the valve guide 60 may be prevented from revolving via a detent device (not shown). Therefore, upon positive and negative rotation of the output shaft 54 of the stepping motor 50, the valve guide 60 may vertically (axially) move. Further, the valve guide 60 may have a supplemental spring 68 that is circumferentially attached thereto. The supplemental spring 68 may be configured to bias the valve guide 60 upward.

The valve body 70 may be composed of a circular cylindrical wall portion 72 and a lower wall portion 74 closing a lower end opening of the cylindrical wall portion 72, so as to have a bottomed circular cylindrical shape. A sealing member 76 made of a disk-shaped rubber-like elastomeric material may be attached to a lower surface of lower wall portion 74. The sealing member 76 of the valve body 70 may be arranged so as to contact an upper surface of the valve seat 40 of the valve casing 30.

The valve body 70 may have a plurality of connecting projection portions 72*t* that are circumferentially formed in an upper outer circumferential surface of the circular cylindrical wall portion 72. Conversely, the valve guide 60 may have vertical groove-like connecting recess portions 62*m* corresponding to the connecting projection portions 72*t* of the valve body 70. The connecting recess portions 62*m* may be formed in an inner circumferential surface of the cylindrical wall portion 62 so as to extend in a moving direction of the valve guide 60. Therefore, the connecting projection portions 72*t* of the valve body 70 may respectively be fitted into the connecting recess portions 62*m* of the valve guide 60 so as to relatively vertically move therein. Further, in a condition in which bottom wall portions 62*b* of the connecting recess portions 62*m* of the valve guide 60 may respectively contact the connecting projection portions 72*t* of the valve body 70 from below, the valve guide 60 and the valve body 70 may move upward (in a valve-opening direction) in combination. Further, a valve spring 77 may be concentrically received between the upper wall portion 64 of the valve guide 60 and the lower wall portion 74 of the valve body 70. The valve spring 77 may function to normally bias the valve body 70 downward, i.e., in a valve-closing direction, relative to the valve guide 60.

Next, a basic action of the closing valve 24 will be described.

The closing valve 24 may be activated by rotating the stepping motor 50 in the valve-opening direction or the valve-closing direction by a predetermined number of steps based on output signals transmitted from the control unit (ECU) 16. That is, upon rotation of the stepping motor 50 by the predetermined number of steps, the valve guide 60 may vertically move by a predetermined stroke amount due to threadable engagement of the male thread portion 54*n* formed in the output shaft 54 of the stepping motor 50 and the female thread portion 66*w* formed in the cylindrical shaft portion 66 of the valve guide 60. For example, the closing valve 24 may be configured such that in a fully opened position, the number of steps and the stroke amount from the initial condition may respectively be about 200 steps and about 5 mm.

As shown in FIG. 4, in an initialized condition (the initial condition) of the closing valve 24, the valve guide 60 may be held in a lower limit position, so that a lower end surface of the cylindrical wall portion 62 of the valve guide 60 may contact the upper surface of the valve seat 40 of the valve casing 30. Further, in this condition, the connecting projection portions 72*t* of the valve body 70 may be positioned above the bottom wall portions 62*b* of the valve guide 60 while the sealing member 76 of the valve body 70 may be pressed against the upper surface of the valve seat 40 of the valve casing 30 by a spring force of the valve spring 77. That is, the closing valve 24 may be held in a fully closed condition. At this time, the number of steps of the stepping motor 50 is equal to zero step, and the axial (upward) travel distance of the valve guide 60, i.e., the stroke amount of the valve guide 60 in the valve-opening direction, is equal to zero mm.

When the vehicle is parked, the stepping motor 50 of the closing valve 24 may rotate by, for example, 4 steps from the initialized condition in the valve-opening direction. As a result, the valve guide 60 may move upward by about 0.1 mm due to the threadable engagement of the male thread portion 54*n* formed in the output shaft 54 of the stepping motor 50 and the female thread portion 66*w* formed in the cylindrical shaft portion 66 of the valve guide 60, so as to be held in a condition in which it is spaced from the valve seat 40 of the valve casing 30. Thus, an excessive force caused by changes in environment such as temperature can be prevented from being applied between the valve guide 60 and the valve seat 40 of the valve casing 30 of the closing valve 24. Further, in this condition, the sealing member 76 of the valve body 70 may be pressed against the upper surface of the valve seat 40 of the valve casing 30 by the spring force of the valve spring 77.

Figure 5:
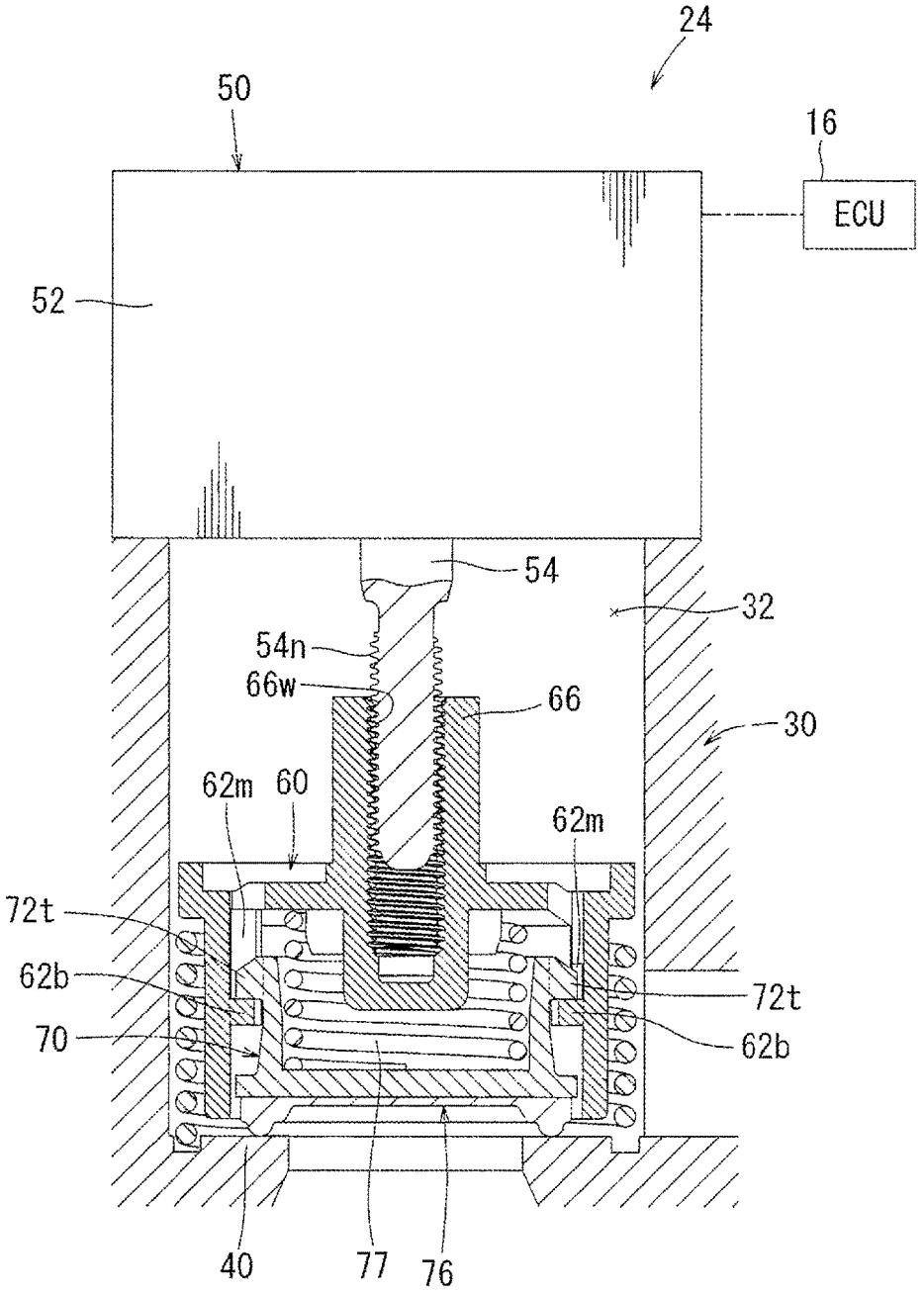
FIG. 5 is a vertical sectional view of the flow control valve similar to FIG. 4, which view illustrates a valve-closed condition.
Figure 6:
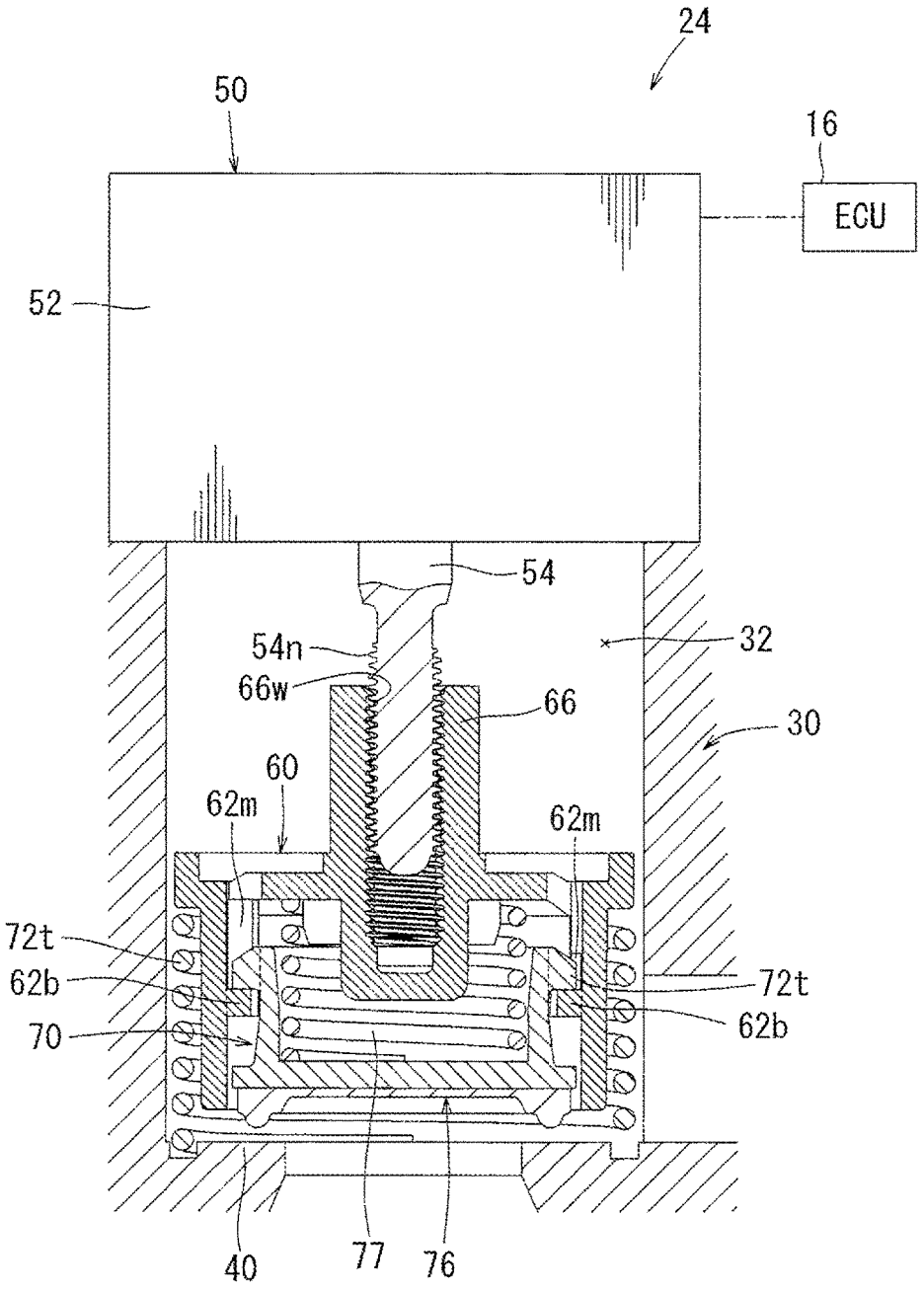
FIG. 6 is a vertical sectional view of the flow control valve similar to FIG. 4, which view illustrates a valve-opened condition.

When the stepping motor 50 further rotates in the valve-opening direction after the stepping motor 50 rotates by 4 steps, the valve guide 60 may move upward due to the threadable engagement of the male thread portion 54*n* and the female thread portion 66*w*. As a result, as shown in FIG. 5, the bottom wall portions 62*b* of the valve guide 60 may respectively contact the connecting projection portions 72*t* of the valve body 70 from below. Thereafter, when the valve guide 60 further moves upward, as shown in FIG. 6, the valve body 70 may move upward with the valve guide 60, the sealing member 76 of the valve body 70 may be spaced from the valve seat 40 of the valve casing 30. Thus, the closing valve 24 may reach the valve-opened condition.

Further, the valve-opening start position of the closing valve 24 may be individually varied due to a positional tolerance of the connecting projection portions 72*t* formed in the valve body 70, a positional tolerance of the bottom wall portions 62*b* of the valve guide 60 or other such factors. Therefore, the valve-opening start position has to be precisely learned. Such learning may be performed via a learning control. In the learning control, the stepping motor 50 of the closing valve 24 may be rotated in the valve-opening direction (i.e., the number of steps of the stepping motor 50 may be increased). Thereafter, when an inner pressure of the fuel tank 15 is reduced by a predetermined value or more, the number of steps corresponding to the valve-opening start position may be detected and stored.

Figure 7:
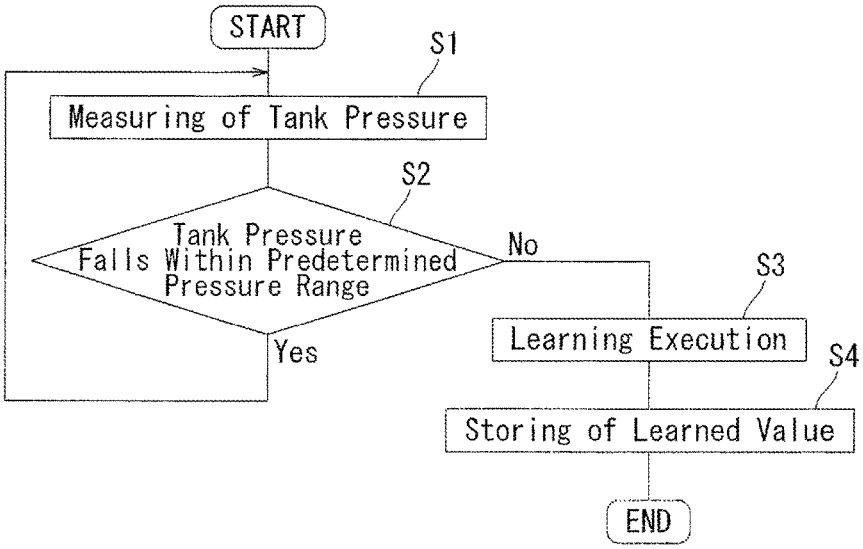
FIG. 7 is a flow chart of a learning control processing routine of a valve-opening start position of the flow control valve in the above-described embodiment.
Figure 8:
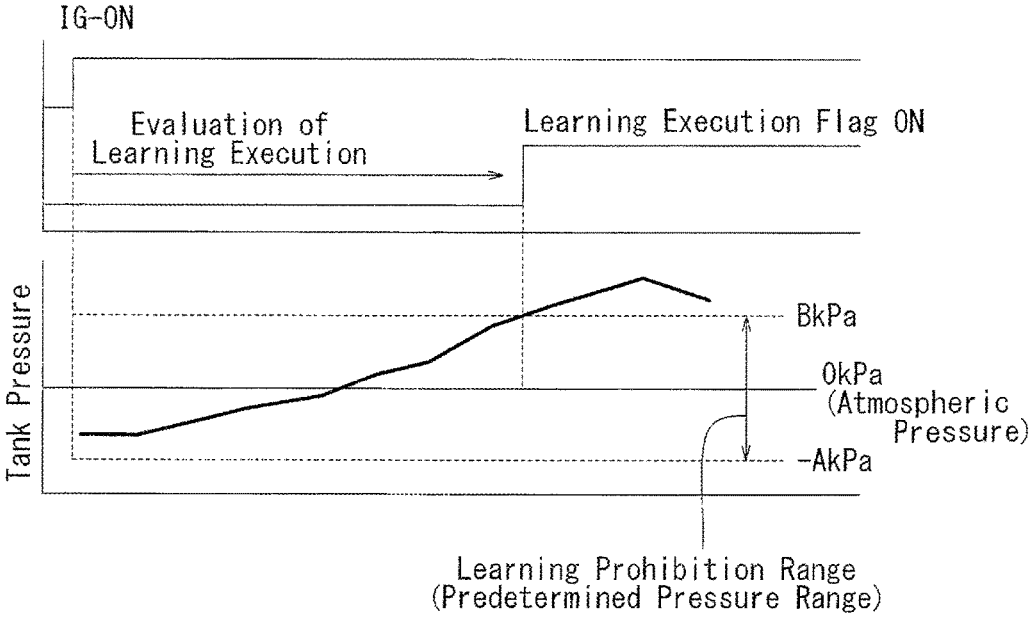
FIG. 8 is a time chart illustrating a relationship between a variation of an inner pressure of a fuel tank and learning execution during a learning control in the above-described embodiment.

Next, a learning control processing routine for learning the valve-opening start position of the stepping motor driven closing valve 24, which routine may be performed in the control circuit 16, will be described with reference to a flow chart of FIG. 7 and a time chart of FIG. 8.

Upon execution of processing of the routine, in Step S1, the fuel tank inner pressure (which may be hereinafter simply referred to as a tank pressure) at the time may be measured by the inner pressure sensor 26 and stored. Next, in Step S2, an evaluation as to whether the tank pressure falls within a predetermined pressure range may be performed. As shown in FIG. 8, the predetermined pressure range may correspond to, for example, a range from minus A kilo Pascal to plus B kilo Pascal relative to the atmospheric pressure set to zero kilo Pascal.

In a condition in which the tank pressure falls within the predetermined pressure range, Step S2 may be affirmed, so as to be returned to the starting point. Conversely, in a condition in which the tank pressure is out of the predetermined pressure range, Step S2 may be disaffirmed, in Step S3, the learning control may be executed. As a result, the closing valve 24 may be opened from the initial condition at a constant rate, so that the valve-opening start position of the closing valve 24 may be determined based on whether a variation of the inner pressure detected by the inner pressure sensor 26 is equal to or greater than the predetermined value. Thereafter, in Step S4, the determined valve-opening start position may be stored as a learned value.

Thus, upon execution of the learning control, a learning execution flag may be set (ON). This process is shown in FIG. 8. That is, when the tank pressure is out of the predetermined pressure range, the learning execution flag may be set. Conversely, when the tank pressure falls within the predetermined pressure range, the range may be considered as a learning prohibition range, i.e., a term to evaluate as to whether the learning control should be executed. The term in which evaluation of learning execution is performed may correspond to a term in which Step S2 in FIG. 7 is being affirmed. A sign "IG-ON" shown in FIG. 8 corresponds to a rising edge of a square wave, which shows that a power switch, i.e., an ignition switch, of the vehicle is turned on. This means that the execution of the processing shown in FIG. 7 may be started when the ignition switch is turned on.

According to the embodiment described above, the valve-opening start position of the closing valve 24 may be determined and learned only under the condition in which the tank pressure is out of the predetermined pressure range relative to the atmospheric pressure. Thus, the valve-opening start position may be prevented from being detected under a circumstance that a differential pressure between the tank pressure and the atmospheric pressure is small. As a result, the valve-opening start position may be prevented from being incorrectly determined.

Further, a sensor configured to detect a gage pressure may be used as the inner pressure sensor 26. Therefore, it is possible to determine as to whether the inner pressure of the fuel tank 15 falls within or is out of the predetermined pressure range relative to the atmospheric pressure by using only an output of the inner pressure sensor 26. As a result, there is no need to respectively provide a sensor to measure the inner pressure of the fuel tank 15 and a sensor to measure atmospheric pressure. This may lead to a simplified structure. Naturally, the inner pressure sensor 26 may be replaced with a sensor to measure the absolute pressure. In this case, a differential pressure between the measured absolute pressure and the atmospheric pressure measured by an additional atmospheric pressure sensor may be detected in order to determine as to whether the inner pressure of the fuel tank 15 falls within or is out of the predetermined pressure range relative to the atmospheric pressure.

In the embodiment, the processing in Step S3 may correspond to a valve-opening start position determination means in the first aspect in the present disclosure. The processing in Step S1 to Step S3 may correspond to a valve-opening start position determination means in the second aspect in the present disclosure. Further, the processing in Step S4 may correspond to a learning means in the first aspect and the second aspect in the present disclosure. Moreover, the processing in Step S1 and Step S2 may correspond to a prohibition means in the first aspect in the present disclosure.

A particular embodiment has been described. However, the embodiment may not be limited to the special structure described above. Therefore, various changes, additions and deletions may be made to the embodiment of the present disclosure without departing from the sprit and the object of the disclosure. For example, in the embodiment described above, the stepping motor driven closing valve 24 is used as the flow control valve. However, the closing valve 24 may be replaced with a ball valve in which valve opening degrees thereof may be continuously changed due to rotation of a ball-shaped valve element. Further, in the embodiment described above, the present disclosure is applied to the engine system of the vehicle. However, the present disclosure may be applied to an engine system other than the vehicle. Further, the engine system of the vehicle may be an engine system of a hybrid vehicle in which an engine and a motor are used in conjunction with each other.

The invention claimed is:

1. An evaporated fuel processing device, comprising:

a fuel tank;

a canister including an adsorbent material configured to adsorb evaporated fuel;

a vapor conduit coupled to the fuel tank and the canister, wherein the vapor conduit is configured to provide the evaporated fuel from the fuel tank to the canister;

a flow control valve disposed along the vapor conduit, wherein the flow control valve has a valve-closed condition in which fluid communication between the canister and the fuel tank is prevented along the vapor conduit, and wherein the flow control valve is held in the valve-closed condition when a stroke amount thereof is equal to or less than a predetermined amount from an initial condition;

a pressure sensor configured to detect a pressure within the fuel tank; and a control unit coupled to the flow control valve and the pressure sensor, wherein the control unit is configured to:

change the stroke amount of the flow control valve from the initial condition in a valve-opening direction;

determine a valve-opening start position of the flow control valve based on a requirement that a variation of the pressure detected by the pressure sensor is equal to or greater than a predetermined value;

store the determined valve-opening start position as a learned value; and prohibit determination of the valve-opening start position when the pressure detected by the pressure sensor falls within a predetermined pressure range relative to the atmospheric pressure.

2. An evaporated fuel processing device, comprising:

a fuel tank;

a canister including an adsorbent material configured to adsorb evaporated fuel;

a vapor conduit coupled to the fuel tank and the canister, wherein the vapor conduit is configured to provide evaporated fuel from the fuel tank to the canister;

a flow control valve disposed along the vapor conduit, wherein the flow control valve has a valve-closed condition in which fluid communication between the canister and the fuel tank is prevented along the vapor conduit, and wherein the flow control valve is held in the valve-closed condition when a stroke amount thereof is equal to or less than a predetermined amount from an initial condition;

a pressure sensor configured to detect a pressure within the fuel tank;

a control unit coupled to the flow control valve and the pressure sensor, wherein the control unit is configured to:

change the stroke amount of the flow control valve from an initial condition in a valve-opening direction when the pressure detected by the pressure sensor is out of a predetermined pressure range relative to the atmospheric pressure;

determine a valve-opening start position of the flow control valve based on a requirement that a variation of the pressure detected by the pressure sensor is equal to or greater than a predetermined value; and store the determined valve-opening start position as a learned value.

3. The evaporated fuel processing device as defined in claim 1, wherein the pressure sensor is configured to detect a gage pressure with respect to the atmospheric pressure as a reference pressure, and wherein the control unit is configured to determine whether the pressure within the fuel tank falls within the predetermined pressure range relative to the atmospheric pressure or not based on only an output of the pressure sensor.

4. The evaporated fuel processing device as defined in claim 2, wherein the pressure sensor is configured to detect a gage pressure with respect to the atmospheric pressure as a reference pressure, and wherein the control unit is configured to determine whether the pressure within the fuel tank is out of the predetermined pressure range relative to the atmospheric pressure or not based on only an output of the pressure sensor.

* * * * *